US006957649B1

(12) United States Patent
Bourgeois

(10) Patent No.: US 6,957,649 B1
(45) Date of Patent: Oct. 25, 2005

(54) GAS FIRED OUTDOOR COOKING APPARATUS

(76) Inventor: Norman Bourgeois, 712 St. George Ave., Jefferson, LA (US) 70121

( * ) Notice: Subject to any disclaimer, the term of this patent is extended or adjusted under 35 U.S.C. 154(b) by 0 days.

(21) Appl. No.: 10/744,956

(22) Filed: Dec. 23, 2003

Related U.S. Application Data

(60) Provisional application No. 60/435,994, filed on Dec. 23, 2002.

(51) Int. Cl.[7] ..... F24C 3/12
(52) U.S. Cl. ..... 126/40
(58) Field of Search ..... 126/40, 30, 9 R, 126/50; 99/340, 413

(56) References Cited

U.S. PATENT DOCUMENTS 4,788,962 A * 12/1988 Mashburn et al. ..... 126/25 R
5,065,735 A * 11/1991 Bourgeois et al. ..... 126/40
5,413,087 A * 5/1995 Jean ..... 126/41 R
5,531,154 A * 7/1996 Perez, III ..... 99/340
5,842,463 A * 12/1998 Hall ..... 126/9 R
5,979,431 A * 11/1999 Hamilton et al. ..... 126/41 R
6,098,611 A * 8/2000 Fillmore ..... 126/50
6,626,090 B2 * 9/2003 McLemore et al. ..... 99/340
6,712,067 B1 * 3/2004 Barbour et al. ..... 126/215

* cited by examiner

*Primary Examiner*—Stephen Gravini
(74) *Attorney, Agent, or Firm*—Garvey, Smith, Nehrbass & Doody, L.L.C.; Charles C. Garvey, Jr.

(57) ABSTRACT

A cooking apparatus includes a frame with an upper section for holding a pot and a lower surface for resting upon an underlying support surface. The frame has a burner element that can be a nozzle tube having a commercially available burner nozzle for generating a cooking flame during use. The nozzle can be fueled with propane, butane or the like using a commercially available tank, regulator and supply hose. The frame can include upper and lower rings, the lower ring providing the lower surface and the upper ring having pot support members for holding the bottom of a pot. One or more heat shields positioned below the flame during use lessen heat transfer from the flame to the underlying support surface.

38 Claims, 4 Drawing Sheets

GAS FIRED OUTDOOR COOKING APPARATUS

CROSS-REFERENCE TO RELATED APPLICATIONS

Priority of U.S. Provisional Patent Application Ser. No. 60/435,994, filed Dec. 23, 2002, incorporated herein by reference, is hereby claimed.

STATEMENT REGARDING FEDERALLY SPONSORED RESEARCH OR DEVELOPMENT

Not applicable

REFERENCE TO A "MICROFICHE APPENDIX"

Not applicable

BACKGROUND OF THE INVENTION

1. Field of the Invention

The present invention relates to outdoor cooking devices and cooking accessories and more particularly to a gaseous fuel fired outdoor cooker that is supplied with a source of gaseous fuel such as butane or propane from a canister and that includes a stand, pot, and pot liner, the improvement including a special configuration of the burner that protects the underlying support (eg. deck or table) when a user foolishly places the burner on a combustible or heat sensitive surface (for example, wood, paper, or plastic).

2. General Background of the Invention

A number of outdoor cookers have been sold commercially for a number of years and are admitted as "prior art" type burners. These "prior art" burners have traditionally included a metallic frame that supports a burner nozzle, such as a cast iron burner nozzle. Such burner nozzles are commercially available and are often a component part of natural gas fired hot water heaters.

Examples of these prior art type outdoor cooking devices can be seen on the Metal Fusion website (www.KingKooker.com). Patents have issued naming Norman Bourgeois as inventor that relate to burners and related cooking apparatus. Examples include U.S. Pat. No. 5,065,735 for a "Convertible Burner Apparatus" that features different primary burner frames and legs that can elevate the burner frames. Other patents that relate to cooking devices include the aforementioned, and patent numbers 1,335,375; 1,671,677; 1,679,567; 1,859,615; 2,355,948; 2,414,679; 2,485,774; 5,065,735; 5,758,569; 5,813,321; 5,970,852; 6,058,830; 6,314,869; 6,439,107, each of which is hereby incorporated herein by reference.

The burner nozzle can be a cast iron hot water heater type burner nozzle or a jet burner arrangement that uses a single orifice or outlet centered in a cylindrically-shaped, vertically oriented metallic tube. Probably the most common version of the prior art "jet burner" arrangement is seen in Metal Fusion's catalog as Model No. 90 PK. Another version of this type of cooker includes two spaced apart circular rings connected with struts and having a cylindrically-shaped wind guard or shroud. This type of prior art burner can be seen for example as Metal Fusion Model Nos. 82 PK, 83 PK, 85 PK, 86 PK, and 86 PKJ. A prior art portable propane outdoor cooker, various outdoor fryers, and other outdoor cookers and related accessories are shown on the Metal Fusion website (www.KingKooker.com).

One of the problems with outdoor cookers is the unfortunate and foolish user that places the burner on a combustible or heat sensitive surface such as a wooden deck, wooden table, plastic table, plastic deck or on newspaper that is spread on a table, floor, etc. If the burner is operated at a very high intensity for a long period of time over a dry wood surface such as an old deck or table, fire could result.

BRIEF SUMMARY OF THE INVENTION

The present invention includes a burner frame having a base for engaging an underlying support surface, the burner frame having a burner nozzle for generating a high intensity flame for use in cooking. A supply hose can be connected to the nozzle for supplying butane, propane or other gaseous fuel product to the burner nozzle. The burner frame has a support surface for cradling a pot.

The burner frame includes a base portion (e.g. ring) and an upper portion (e.g. ring) with legs connecting the upper and lower portions.

The upper portion supports pot support bars or a grate (e.g. multiple grate members) that can extend horizontally to cradle the bottom of a cooking pot.

A heat shield is supported by the burner frame, at a position below the flame that emits from the nozzle tube. A pair of heat shields can be provided (e.g., welded to the frame). A first shield can be positioned just below the top of the nozzle tube and a second shield can be positioned below the first shield.

One of the shields can be positioned at an elevation next to the burner element.

The burner element can be a vertically oriented tube with a hollow bore. A nozzle is typically placed inside the tube bore so that during cooking the nozzle discharges gaseous fuel upwardly to supply a flame for cooking. Such a vertical tube, bore and nozzle arrangement per se is well known in the art, having been widely sold for decades.

One of the shields can be placed below the burner nozzle. When a vertical tube and nozzle are used, one of the shields can be placed below the vertical tube.

The shields can be of a transverse diameter that is much greater than the transverse diameter of the tube, and can be approaching pot diameter or a greater than pot diameter.

BRIEF DESCRIPTION OF THE SEVERAL VIEWS OF THE DRAWINGS

For a further understanding of the nature, objects, and advantages of the present invention, reference should be had to the following detailed description, read in conjunction with the following drawings, wherein like reference numerals denote like elements and wherein.

DETAILED DESCRIPTION OF THE INVENTION

Figure 2:
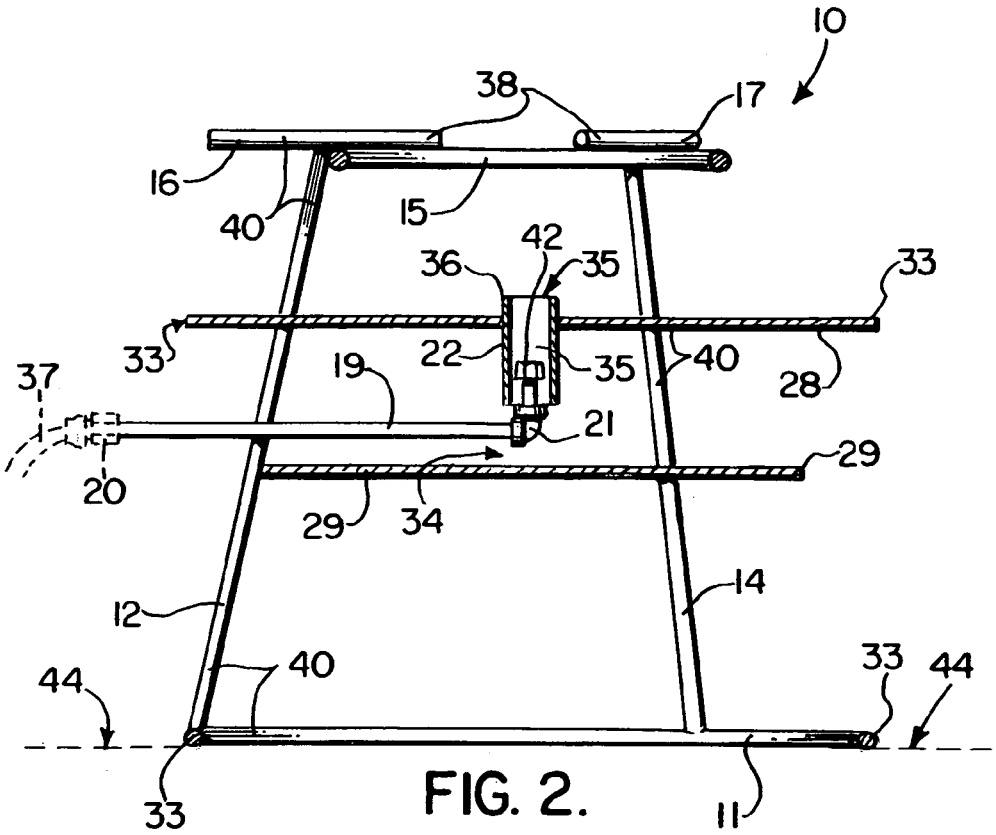
FIG. 2 is a sectional, elevation view of the preferred embodiment of the preferred embodiment of the apparatus of the present invention taken along lines 2-2 of FIG. 1.

Burner apparatus 10 provides burner frame 40 that includes a lower end portion with a base that can be a ring 11 and an upper end portion that can be a ring 15. A plurality of preferably three legs 12, 13, 14 span between base ring 11 and upper end portion ring 15. The rings 11, 15 and legs 12, 13, 14 can be connected together using welding, for example. The rings 11, 15 and the legs 12, 13, 14 can be of steel or stainless steel as examples.

The upper end portion of frame 40 provides a grate 38 for holding a known pot 39 with known liner or basket 41. A plurality of preferably three or more pot support bars (e.g., steel) 16, 17, 18 can define grate 38 and can be attached to the upper surface of upper ring 15, for example, being welded thereto. Legs 11, 12, 13 can be welded to the combination of ring 15 and pot support bars 16, 17, 18 (see FIGS. 1–3).

A fuel supply line 19 extends horizontally, being welded to frame 40 at leg 12 as shown in FIG. 2. Fuel line 19 provides at one of its end portions an inlet fitting 20 to which a commercially available hose 37, pressure regulator, and fuel (e.g. propane, butane, etc.) tank (or other suitable fuel supply) can be attached.

An end of fuel line 19 opposite fitting 20 provides an elbow 21 that carries a known and a commercially available nozzle jet 42. Nozzle tube 22 has an open ended bore 35. Tube 22 extends around the nozzle jet 42 and channels the flame that is generated at the nozzle 42 upwardly toward the cooking pot 39 that is supported by bars 16, 17, 18 of grate 38.

Figure 1:
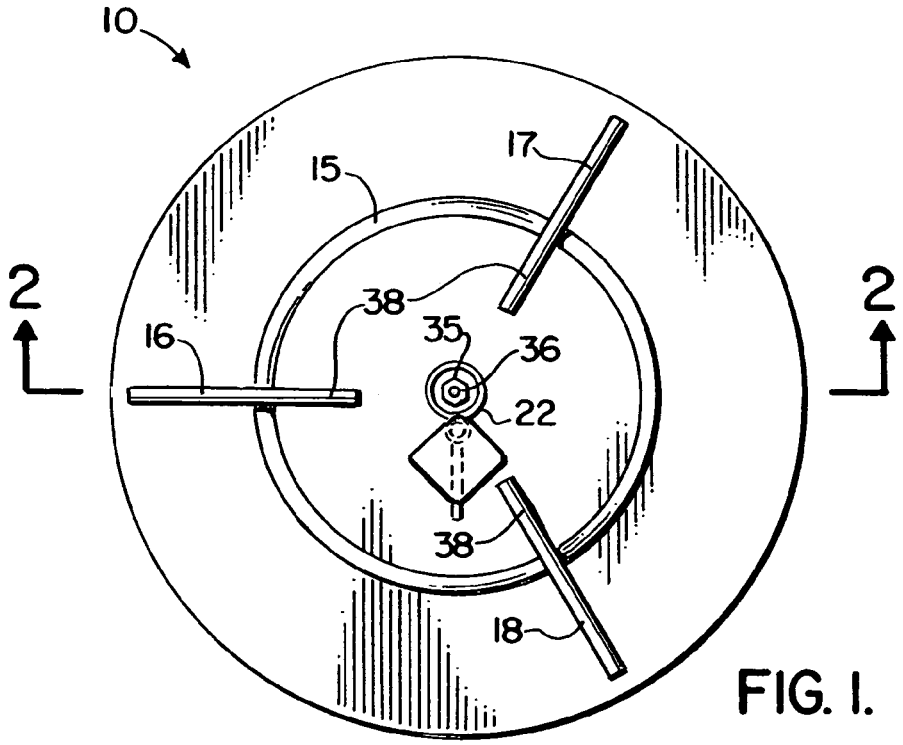
FIG. 1 is a plan view of the preferred embodiment of the apparatus of the present invention.
Figure 3:
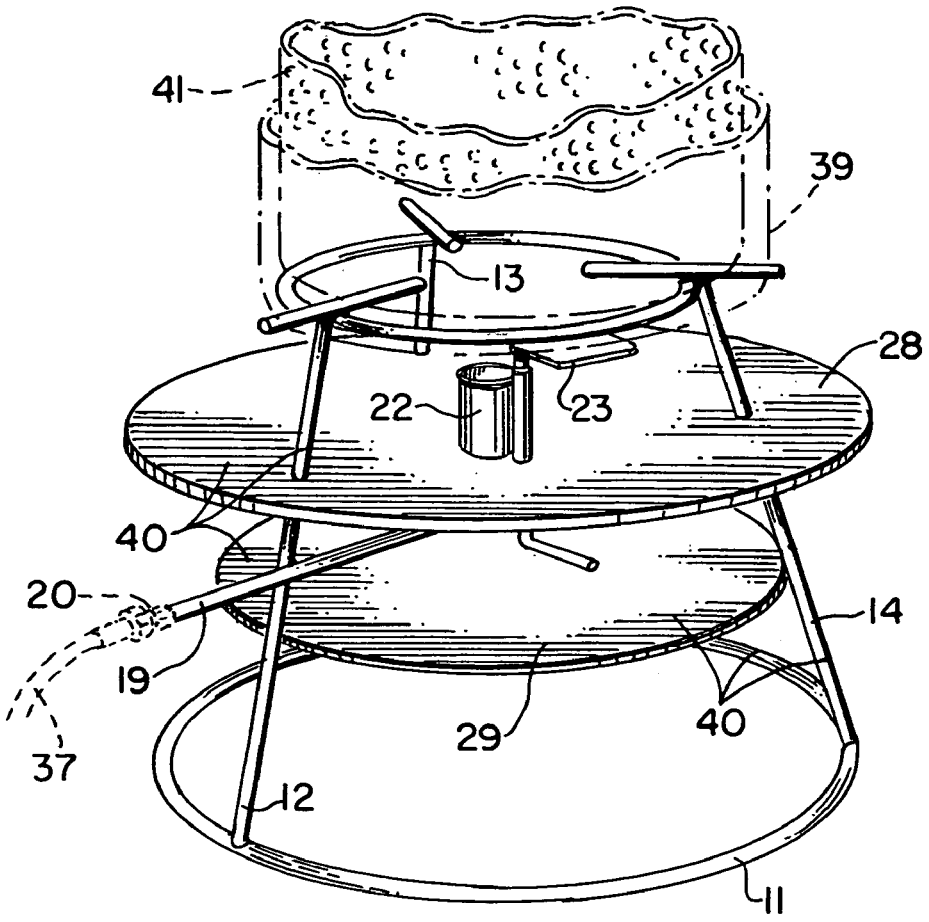
FIG. 3 is a perspective view of the top view of the preferred embodiment of the apparatus of the present invention.
Figure 4:
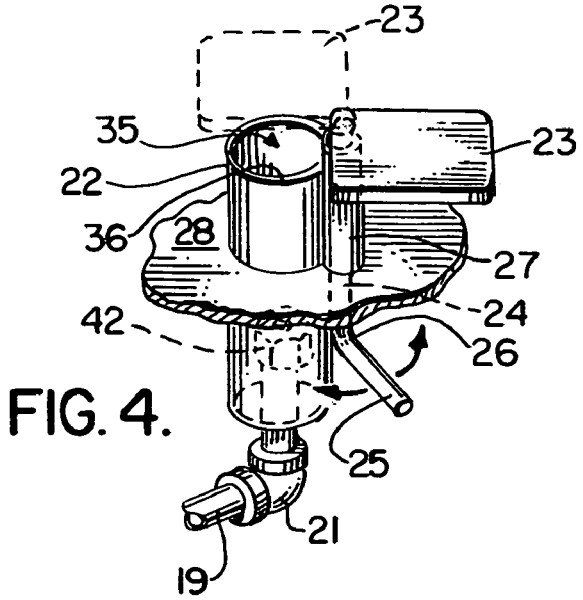
FIG. 4 is a fragmentary perspective view of the preferred embodiment of the apparatus of the present invention illustrating te vertical tube, nozzle and shield in detail.

A jet baffle 23 can be rotated to a position above nozzle tube 22 as shown in FIG. 1 or can be mounted to tube 22 so that it can be rotated toward or away from nozzle tube 22 as shown in FIGS. 1, 3 and 4 to vary heat intensity that is directed to the pot 39.

Baffle rod 24 is mounted in baffle sleeve 27. Jet baffle 23 is mounted (for example, welded) to top of baffle rod 24. A bend 26 in baffle rod 24 provides an offset lower end portion 25 that can be gripped by a user and rotated in order to rotate baffle rod 24 and jet baffle 23 to position it in a desired location before lighting of the burner 10. Such jet baffles 23 are known prior art.

Upper heat shield 28 is supported by the frame 40. Shield 28 can be attached to frame 40 at the legs 12, 13, 14, being welded thereto, for example. The upper heat shield 28 can be positioned at an elevation that is next to tube 22, e.g., in between the upper end 36 and bottom of nozzle tube 22 as shown in FIG. 2. Shield 28 extends radially from nozzle tube 22 to periphery 33 (See FIGS. 1, 2, and 3).

Lower heat shield 29 is attached to the frame 40 at legs 12, 13, 14, (for example, being welded thereto). Lower heat shield 29 is at an elevation that is below nozzle tube 22 providing a gap 34 that enables air to enter the bottom of nozzle tube 22 so that air can enter nozzle tube bore 43 and reach the flame that emits from the nozzle jet 42 in tube 22 and ensure combustion.

Periphery 33 can be at the outer edge of lower ring 11, or at the outer edge of grate 37, or it can be about equal to or greater than the diameter of pot 39. Notice in FIG. 1 that the periphery 33 of upper heat shield 28 can extend further from nozzle tube 22 than the periphery 32 of pot support bars 16, 17, 18 (and can extend beyond the periphery of any pot 39 placed on bars 16, 17, 18. This configuration ensures that the flame exiting the top 36 of nozzle tube 22 will be reflected upwardly, preventing excessive heat from being transferred to a surface 44 upon which lower ring 11 rests.

The upper and lower heat shield 28, 29 provide a safety feature for preventing excess heat transfer to surface 44. The heat shields 29, 30 thus prevent excessive transfer to surface 44 and, hopefully, prevent fire if a user foolishly places the burner 10 on a combustible or heat sensitive surface such as a wooden deck, wooden table, plastic, or paper articles.

In FIGS. 5–9, an alternate embodiment of the apparatus of the present invention is shown, designated generally by the numeral 50. Outdoor cooking apparatus 50 is an alternate embodiment that illustrates a collapsible outdoor cooking apparatus that can more easily be stored in a reduced area. Base ring 51 supports preferably three legs 52, 53, 54. Each leg has an upper end portion 55 that is hollow and provides an internal thread 56. Each leg 52, 53, 54 can removably attach at its upper end portion to a strut 57, 58, 59 respectively.

Figure 5:
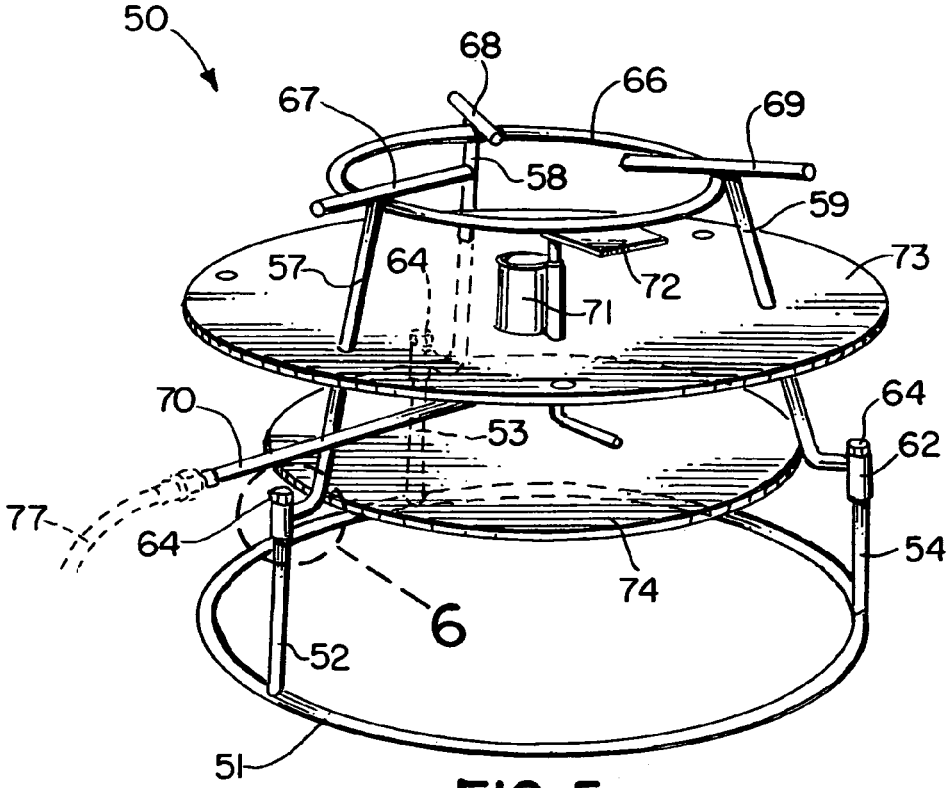
FIG. 5 is perspective view of an alternate embodiment of the apparatus of the present invention.
Figure 6:
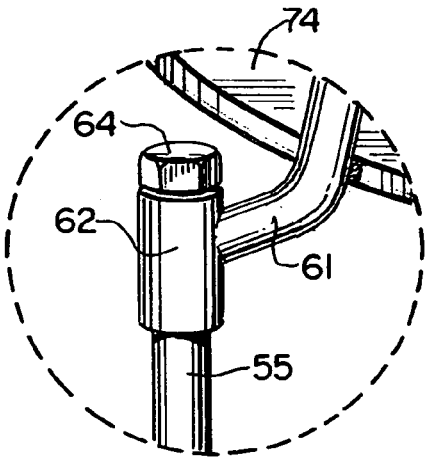
FIG. 6 is a fragmentary view of the alternate embodiment of the apparatus of the present invention.

Each strut 57, 58, 59 provides a lower end portion 60 that has a bend 61 and hollow sleeve 62. Sleeve 62 is preferably generally vertically oriented and provides sleeve bore 63. For assembling the outdoor cooking apparatus 50 in the operating position that is shown in FIG. 5, bolt 64 passes through bore 63 of sleeve 62 and forms a threaded connection with internal threads 56 at upper end portion 55 of each leg 52, 53, 54.

Figure 7:
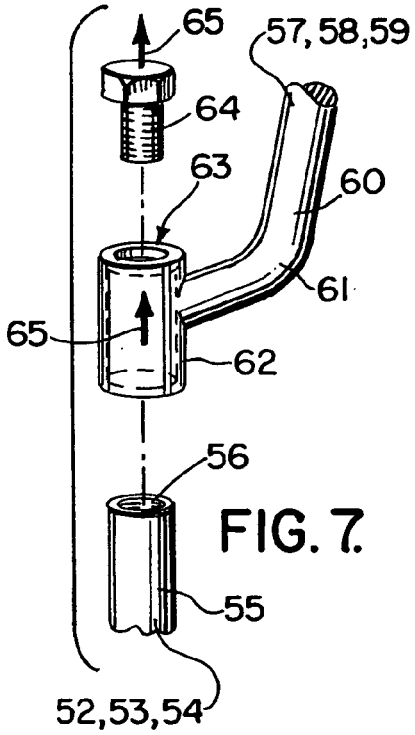
FIG. 7 is an exploded, partial perspective view of the alternate embodiment of the apparatus of the present invention.

In order to disassemble the apparatus for storage or shipment, the bolts 64 are removed in the direction of arrows 65 as shown in FIG. 7 so that each strut 57, 58, 59 separates from its respective leg 52, 53, 54.

An upper ring 66 is attached to the upper end portion of each of the struts 57, 58, 59 with a connection that can be welded, for example. A pot support bar is attached (i.e. welded) to upper ring 66 next to each of the struts 57, 58, 59. As shown, for example, in FIGS. 5, 8 and 9, pot support bar 67 attaches to upper ring 66 next to strut 57. Pot support bar 68 attaches to ring 66 next to strut 58. Pot support bar 69 attaches to ring 66 next to strut 59.

A conduit 70 is provided for supplying a selected gas fuel product such as propane, butane or the like to burner element 71. A flexible hose 77 can be used to supply a selected food product to conduit 70. Burner element 71 can be provided with a jet baffle 72. The construction of conduit 70, burner element 71 and jet baffle 72 can be as shown and described with respect to the preferred embodiment of FIGS. 1–4, providing a horizontal fuel line, elbow, nozzle, and nozzle tube such as is shown in FIGS. 1 and 2. The jet baffle 72 can be provided with a rotary connection to the outside of the nozzle tube as shown with respect to FIGS. 1–4.

Figure 8:
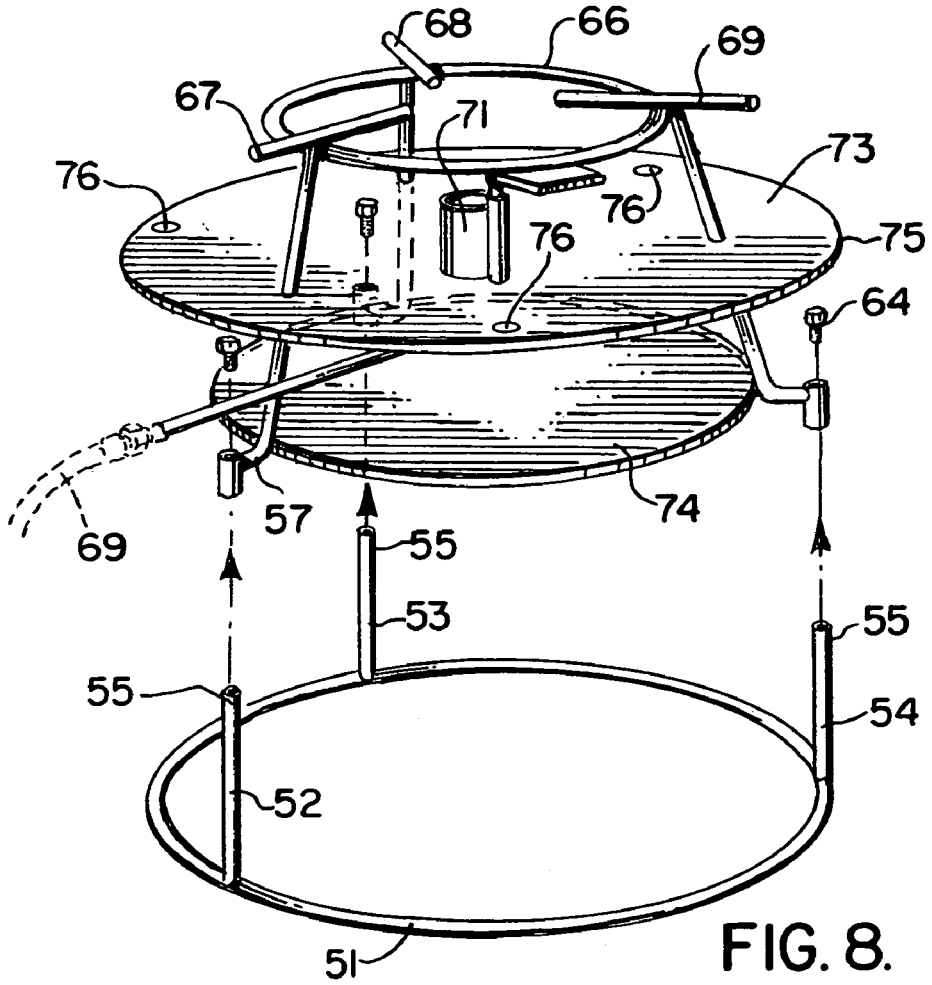
FIG. 8 is an exploded view of the alternate embodiment of the apparatus of the present invention.
Figure 9:
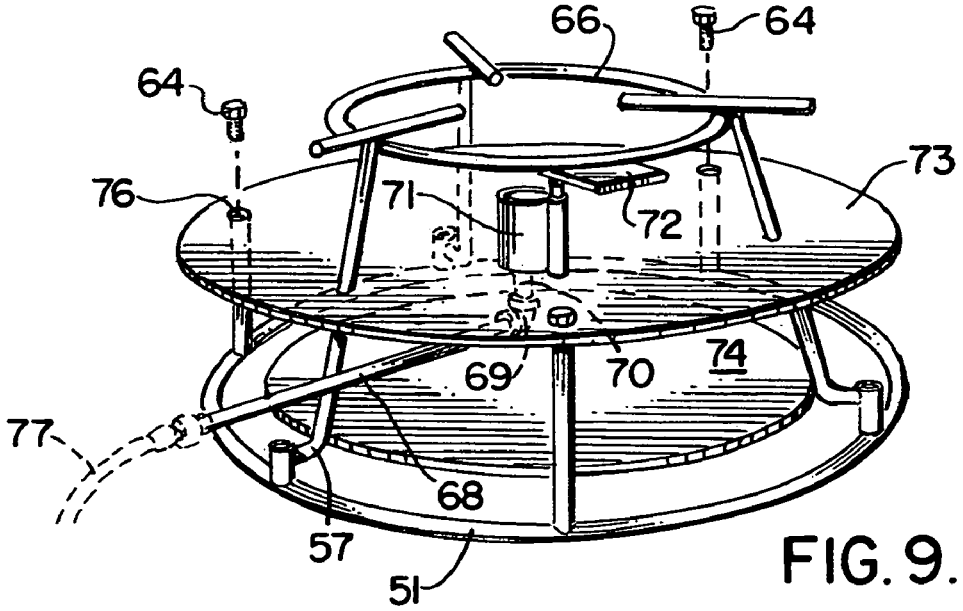
FIG. 9 is a perspective view of the alternate embodiment of the apparatus of the present invention shown in a collapsed, storage or shipping position.

Upper baffle plate 73 can be attached (for example, welded) to struts 57, 58, 59 as shown in FIGS. 5, 8 and 9. Lower baffle plate 74 can be attached (for example, welded) to struts 57, 58, 59. The lower baffle plate 74 is welded to struts 57, 58, 59 next to the bend 61 portion thereof as shown in FIGS. 5, 6, 8 and 9. The upper baffle plate 73 can be attached to struts 57, 58, 59, being welded thereto at a position generally in between bend 61 and ring 66 and below the top of burner element 71.

Upper baffle plate 73 has a periphery 75 provided with a plurality of circumferentially spaced apart opening 76. In the collapsed storage or transport position of FIG. 9, bolts 64 can be placed through openings 76 in baffle plate 73 and then connected to the internal threads 56 of upper end portion 55 of struts 52, 53, 54.

Parts List

The following is a list of parts and materials suitable for use in the present invention:

| Parts Number | Description |
|---|---|
| 10 | outdoor cooking apparatus |
| 11 | base ring |
| 12 | leg |
| 13 | leg |
| 14 | leg |
| 15 | upper ring |
| 16 | pot support bar |
| 17 | pot support bar |
| 18 | pot support bar |
| 19 | fuel line |
| 20 | inlet fitting |
| 21 | elbow |
| 22 | nozzle tube |
| 23 | jet baffle |
| 24 | baffle rod |
| 25 | lower end portion |
| 26 | bend |
| 27 | baffle sleeve |
| 28 | upper heat shield |
| 29 | lower heat shield |
| 30 | attachment |
| 31 | attachment |
| 32 | periphery |
| 33 | periphery |
| 34 | gap |
| 35 | tube bore |
| 36 | upper end |
| 37 | hose |
| 38 | grate |
| 39 | pot |
| 40 | burner frame |
| 41 | basket |
| 42 | nozzle jet |
| 43 | tube bore |
| 44 | underlying support surface |
| 50 | outdoor cooking apparatus |
| 51 | lower ring |
| 52 | leg |
| 53 | leg |
| 54 | leg |
| 55 | upper end portion |
| 56 | internal thread |
| 57 | strut |
| 58 | strut |
| 59 | strut |
| 60 | lower end portion |
| 61 | bend |
| 62 | sleeve |
| 63 | sleeve bore |
| 64 | bolt |
| 65 | arrow |
| 66 | upper ring |
| 67 | pot support bar |
| 68 | pot support bar |
| 69 | pot support bar |
| 70 | conduit |
| 71 | burner element |
| 72 | jet baffle |
| 73 | upper baffle plate |
| 74 | lower baffle plate |
| 75 | periphery |
| 76 | opening |
| 77 | hose |

The foregoing embodiments are presented by way of example only; the scope of the present invention is to be limited only by the following claims.

What is claimed is:

1. A cooking apparatus, comprising:

a) a burner having a frame that includes a base for engaging an underlying support surface, the frame having a burner element for generating a high intensity flame for use in cooking, the burner frame having an upper end portion with a support surface for cradling a pot;

b) the frame including a nozzle tube having upper and lower end portions, the nozzle tube being positioned to extend above the burner element and providing an open ended bore that contains the flame generated by the burner element during cooking;

c) the frame including pot supports next to the upper end portion for holding a pot; and d) at least one heat shield that is positioned below the flame during cooking and that is connected to the nozzle tube and that extends radially and circumferentially with respect to the nozzle tube; and e) the lower end portion of the nozzle tube providing an open end portion that extends below the heat shield.

2. The cooking apparatus of claim 1, wherein the base is a ring.

3. The cooking apparatus of claim 1 wherein the upper end portion includes a circular ring portion of the frame.

4. The cooking apparatus of claim 1 wherein there are a pair of vertically spaced apart heat shields attached to the frame.

5. The cooking apparatus of claim 1 further comprising a cooking pot.

6. The cooking apparatus of claim 1 wherein the heat shield extends radially beyond the pot supports.

7. The cooking apparatus of claim 1 wherein the heat shield is welded to the frame.

8. The cooking apparatus of claim 1 wherein the frame includes upper and lower rings and legs that are attached to the rings.

9. A cooking apparatus, comprising:

a) a burner having a frame that includes a base for engaging an underlying support surface, the frame having a burner element for generating a high intensity flame for use in cooking, the burner frame having a pot support surface for cradling a pot;

b) the frame including a nozzle tube that houses a nozzle for emitting gaseous fuel that is ignited during use to form a flame that extends from the nozzle tube upwardly to a pot supported upon the upper end of the frame, the nozzle tube being an open ended tubular member having upper and lower end portions;

c) means below the flame during cooking for reflecting heat from the flame away from the underlying support surface, said means including a baffle plate that is connected to the frame and that extends radially and circumferentially with respect to the nozzle tube.

10. The cooking apparatus of claim 9, further comprising a second baffle plate below the first baffle plate.

11. The cooking apparatus of claim 9 wherein the base is a circular ring portion of the frame.

12. The cooking apparatus of claim 9 wherein there are at least three circumferentially spaced apart pot supports that comprise the pot support surface.

13. The cooking apparatus of claim 9 wherein the upper end portion of the frame includes a upper ring portion.

14. The cooking apparatus of claim 9 wherein the upper ring has the pot support.

15. A cooking apparatus, comprising:

a) a burner having a frame that includes a base for engaging an underlying support surface, the frame having a burner element for generating a high intensity flame for use in cooking and a hollowed tube that extends above the burner element, the tube having a top, a bottom, and a bore that is receptive of the flame, the burner frame having a support surface for cradling a pot above the flame during cooking;

b) a pot having a pot periphery, the pot including a generally flat bottom portion, a generally cylindrically shaped continuous sidewall, the pot having a generally cylindrically shaped interior;

c) a burner shield that is supported by the frame, being connected to the tube below the top of the tube and positioned below the flame during cooking, the shield being a radially and circumferentially extending member that extends radially from a position next to the tube to a position that approaches the periphery of the pot.

16. The cooking apparatus of claim 15, wherein there are a pair of heat shields attached to the frame at upper and lower spaced apart positions.

17. The cooking apparatus of claim 15 wherein the heat shield extends beyond the periphery of the pot.

18. The cooking apparatus of claim 16 wherein at least one of the heat shields extends beyond the periphery of the pot.

19. The cooking apparatus of claim 15 further comprising a food holder that fits inside the pot interior, the food holder having a base that registers against the bottom of the pot and a vertically extending portion that enables a user to lift the food holder.

20. A cooking apparatus, comprising:

a) a burner having a frame that includes a base for engaging an underlying support surface;

b) the burner frame having an upper end portion with a support surface for supporting a pot, the frame having a burner element for generating a high intensity flame for use in cooking;

c) a nozzle tube having upper and lower end portions, the nozzle tube providing an open ended bore and the burner element generating a flame during cooking that is emitted from the upper end portion of the tube;

d) the frame supporting at least one heat shield that is positioned below the flame during cooking and that extends radially and circumferentially with respect to the burner element.

21. The cooking apparatus of claim 20, wherein the base includes a ring.

22. The cooking apparatus of claim 20 wherein the frame upper end portion includes a circular ring.

23. The cooking apparatus of claim 20 wherein there are a pair of vertically spaced apart heat shields attached to the frame.

24. The cooking apparatus of claim 20 further comprising a cooking pot that is supported.

25. The cooking apparatus of claim 20 wherein the heat shield extends radially beyond the pot supports.

26. The cooking apparatus of claim 20 wherein the heat shield is welded to the frame.

27. The cooking apparatus of claim 20 wherein the frame includes an upper and a lower ring, and legs that are attached to each of the rings.

28. A cooking apparatus, comprising:

a) a burner having a frame that includes a base for engaging an underlying support surface;

b) during use upon the grate support surface a burner element for generating a high intensity flame for use in cooking;

c) a pot support surface on the frame for holding a pot above the frame;

d) the frame including a nozzle tube that houses a nozzle for emitting gaseous fuel that is ignited during use to form a flame that extends from the nozzle tube upwardly to a pot supported upon the upper end of the frame, the nozzle tube being an open ended tubular member having upper and lower end portions;

e) means positioned below the flame during cooking for reflecting heat generated by the flame away from the underlying support surface, said means including a baffle plate that is connected to the frame and that extends radially and circumferentially with respect to the nozzle tube.

29. The cooking apparatus of claim 28, further comprising a second baffle plate below the first nozzle plate.

30. The cooking apparatus of claim 28 wherein the base is a circular ring portion of the frame.

31. The cooking apparatus of claim 28 wherein there are at least three circumferentially spaced apart pot supports that comprise the pot support surface.

32. The cooking apparatus of claim 28 wherein the upper end portion of the frame includes a upper ring portion.

33. The cooking apparatus of claim 28 wherein the upper ring has the pot support.

34. A cooking apparatus, comprising:

a) a burner having a frame that includes a lower end portion for engaging an underlying support surface and an upper end portion;

b) the frame having a hollowed tube having a tube bore and a burner element for generating a high intensity flame for use in cooking that is emitted upwardly from the tube bore;

c) a support surface for holding a pot above the flame during cooking;

d) a pot having a pot periphery, the pot including a generally flat bottom portion, a generally cylindrically shaped continuous sidewall, the pot having a generally cylindrically shaped interior;

e) a burner shield that is supported by the frame below the flame during cooking, the shield being a radially and circumferentially extending member that extends radially from a position next to the burner element to a position that approaches the periphery of the pot.

35. The cooking apparatus of claim 34, wherein there are a pair of heat shields attached to the frame.

36. The cooking apparatus of claim 34 wherein the heat shield extends beyond the periphery of the pot.

37. The cooking apparatus of claim 35 wherein at least one of the heat shields extends beyond the periphery of the pot.

38. The cooking apparatus of claim 34 further comprising a food holder that fits inside the pot interior, the food holder having a base that registers against the bottom of the pot and a vertically extending portion that enables a user to lift the food holder.

* * * * *